US005926884A

United States Patent [19]

Biggie et al.

[11] Patent Number: 5,926,884

[45] Date of Patent: Jul. 27, 1999

[54] AIR DISTRIBUTION DEVICE FOR THE PREVENTION AND THE TREATMENT OF DECUBITUS ULCERS AND PRESSURE SORES

[75] Inventors: John Biggie, Lighthouse Point; Lydia B. Biggie, Lighthouse, both of Fla.

[73] Assignee: Sentech Medical Systems, Inc., Ft. Lauderdale, Fla.

[21] Appl. No.: 08/906,486

[22] Filed: Aug. 5, 1997

[51] Int. Cl.[6] ..... A61G 7/057; A47C 27/10

[52] U.S. Cl. ..... 5/714; 5/713; 297/180.13

[58] Field of Search ..... 5/713, 714, 715, 5/710, 652.2; 297/180.11, 180.13

[56] References Cited

U.S. PATENT DOCUMENTS

| | | | |
|---|---|---|---|
| 3,757,366 | 9/1973 | Sacher | 5/652.2 |
| 4,225,989 | 10/1980 | Corbett et al. | 5/714 |
| 4,267,611 | 5/1981 | Agulnick | 5/713 |
| 4,347,633 | 9/1982 | Gammons et al. | 5/714 |
| 4,391,009 | 7/1983 | Schild et al. | 5/714 |
| 4,653,130 | 3/1987 | Senoue et al. | 5/714 |
| 4,944,060 | 7/1990 | Peery et al. | 5/713 |
| 5,010,608 | 4/1991 | Barnett et al. | 5/713 |
| 5,103,519 | 4/1992 | Hasty | 5/713 |
| 5,370,439 | 12/1994 | Lowe et al. | 297/180.11 |
| 5,375,273 | 12/1994 | Bodine, Jr. et al. | 5/715 |
| 5,509,155 | 4/1996 | Zigarac et al. | 5/714 |

*Primary Examiner*—Alex Grosz

*Attorney, Agent, or Firm*—Malin, Haley, DiMaggio & Crosby, PA

[57] ABSTRACT

An air distribution device with a plurality of sheets is provided to prevent and treat decubitus ulcers. Air from an air source is provided between sheets of the coverlet which are air tight except for a plurality of very tiny apertures that are provided in the top sheet. The device is used between a support surface such as an alternating pressure mattress and a patient. The air escaping from the tiny apertures circulates around the patient to remove excess moisture from the patient's skin and wounds. The top sheet of the coverlet is made of a low friction nylon with an undercoating of a waterproof yet vapor permeable polyurethane. The top sheet has a plurality of apertures punched through the material. The central sheet is made out of the identical material of the top sheet, except there are no tiny apertures. The central sheet is a diffuser sheet, in that no air flow passes through it, but it spreads the air throughout the air tight portion of the device, allowing air to escape through the apertures in the top sheet directly to the patient. The bottom sheet is preferably a quilted synthetic material such as DACRON™ to provide a space for the vapor molecules, once they have passed through the coated nylon, to travel into and disperse.

2 Claims, 2 Drawing Sheets

AIR DISTRIBUTION DEVICE FOR THE PREVENTION AND THE TREATMENT OF DECUBITUS ULCERS AND PRESSURE SORES

BACKGROUND OF THE INVENTION

1. Field of the Invention

This invention relates to bed and chair coverlets, pads, and covers for preventing, reducing, and treating decubitus ulcers, known as pressure sores and bed sores, by providing a low friction surface against a patient's skin, by absorbing vapor and moisture coming from the patient, and by circulating an amount of air beyond normal ambient air convection to keep wounds dry, to promote healing, and to regulate body temperature.

2. Description of Related Art

It is well known that patients that stay in bed or chairs for extended periods of time can develop decubitus ulcers, pressure sores, or bed sores. The ulcers are often caused by the reduction of blood flow to soft tissues that are compressed by the weight of the patient between the bed or chair surface and bony prominences of the patient. The continued lack of blood flow, and resultant lack of oxygen, cause cells to die and eventually cause the ulcers. The time-frame for occurrence of these ulcers depends on various factors such as the firmness and friction of the surface against the patient's skin, temperature, moisture, and the health and susceptibility of the skin due to age or illness.

To allow blood to flow to the areas of restriction, the patients are often turned regularly by nursing or hospital personnel to reduce the occurrence of the ulcers. Turning of the patients is not always possible, especially if the patient is not in a facility that provides such services.

Alternately, attempts have been made to reduce the occurrence of decubitus ulcers by mattresses or pads that are intended to more evenly redistribute the pressure under bony prominences. Redistribution of skin pressure is accomplished by static support surfaces such as foam mattresses and air or water mattresses and the like, and by alternating pressure inflatable mattresses that dynamically shift the location of support pressure under the patient. The alternating pressure mattresses can have a series of side-by-side inflatable air chambers or cells that are alternately inflated and deflated in a manner that shifts the support location under the patient to and from adjacent air chambers. An example of an alternating pressure inflatable support surface is illustrated in U.S. Pat. No. 5,509,155, the disclosure of which is incorporated herein by reference.

The alternating pressure inflatable support surfaces can also include an additional feature to help heal the skin after breakdown or to help in the prevention of skin breakdown. The feature is called "low air loss", and the purpose is to circulate a low amount of air, beyond normal air convection, to remove moist air vapor given off by the patient, to keep wounds dry and to promote healing.

Until now, there were essentially two approaches to providing a low air loss feature, with both approaches resulting in "low air loss mattresses". Low air loss mattresses are alternating support pressure inflatable mattresses that include a low air loss feature as an integral part of the mattress. The patient normally lies on a vapor permeable coverlet on top of the low air loss mattress. The low air loss feature circulates air below the coverlet to dry moisture coming from the patient and passing through the coverlet to the space between the coverlet and the mattress.

The two approaches heretofore available for providing a low air loss feature are:

First, tiny holes are provided in the top surface of the inflatable air cells. The tiny holes allow extra air to circulate between the air cell array and the coverlet on which the patient lies to evaporate vapor moisture.

Second, an air tube is run from the air pump to the air cell enclosure, but exterior to the alternating pressure air cells themselves. The additional air tube blows excess air in the same manner as holes in the air cells. However, some sort of diffuser sheet is normally required to somewhat evenly spread the air throughout the space below the patient.

There are several disadvantages with these approaches of providing low air loss. For the first approach, a large compressor pump must be used to have sufficient volume of air to inflate the air cells, and to keep up with the demand of continually loosing air through the holes provided in the air cells that are trying to be inflated. Large compressor pumps tend to be noisy and have high electrical consumption. The second approach includes the same problem.

In both approaches the amount of moisture removed is only that which comes through the vapor permeable coverlet on which the patient is lying. Generally, no air actually reaches the patient to remove excess moisture on the wounds or from the skin surface.

Primarily in the first approach, there is a trade off on how many holes can be provided in the air cells and the volume of the pump and its ability to keep up with the demand. The typical system has only a few holes on about 50% of the air cells, allowing for low or poor air distribution. If more holes are punched in the air cells directly under the patient, these air cells will loose air faster, with the patient tending to bottom out on the bed.

In both these approaches, as stated above, no air reaches the patient directly. The patient lies on a waterproof yet vapor permeable coverlet, which does not allow air to blow through the coverlet. Air flowing directly to the patient's skin drys wounds and promotes healing.

Some systems have the patient lying on a loose woven material, that is not waterproof, and also happens to have a less smooth surface causing shear on the patient's skin. The loose woven material allows air to pass through, but looses the other characteristics of waterproof yet vapor permeable material, including patient comfort. If the patient were to lie directly on the mattress, the patient would at least partially clog the tiny holes in the air cells preventing the low air loss feature. Also, the moist vapor given off by the patient could not pass through the vapor barrier material of the air cells resulting in a sweaty and uncomfortable patient.

With both of the above approaches, the low air loss option cannot be turned on or off independently of the air flow to the mattress. If the low air loss therapy is not desired, a different system must be utilized with another controller and a different air cell array.

Examples of low air loss mattresses, that include the above mentioned disadvantages, are disclosed in U.S. Pat. Nos. 4,267,611; 4,653,130; and 5,375,273. The '611 and '273 patents discloses utilizing small holes directly in the air chambers or air cells of alternating pressure inflatable mattresses to provide escaping air between the mattress and the patient. The '273 patent additionally discloses utilizing a vapor-permeable sheet between the low air loss mattress and the patient. The escaping air flows between the mattress and the vapor-permeable sheet and not directly onto the patient. See the '273 patent at col. 1, lines 54–66.

The '130 patent discloses an alternating pressure inflatable mattress having an air cell array with tiny holes therein to provide escaping air to the patient, and which is separate from the alternating pressure inflatable cells used for patient support. The '130 patent is an example of the second approach described herein above.

The present invention provides a totally new device to provide a low air loss feature by providing a low air loss coverlet.

SUMMARY OF THE INVENTION

The present invention provides an air distribution device for the prevention of decubitus ulcers comprising at least a lower absorbent sheet, a waterproof central sheet, and a waterproof upper sheet disposed adjacent each other in a layered manner and connected together around the perimeter forming a cover or coverlet, and an air supply in fluid communication with the sheets. The upper sheet includes a plurality of tiny apertures disposed in a preselected pattern to deliver air from the air supply to a patient.

Air from an air source is provided between the sheets of the device which are connected together forming an essentially air tight chamber except for the plurality of tiny apertures that are provided in the top sheet. The number of apertures is preferably over 6000 and can be placed in a preselected specific geometric pattern that provides the most benefit to the patient. The device can be used between a mattress or chair and the patient. The air escaping from the tiny apertures in the upper sheet circulates around the patient to remove excess moisture from the patient's skin and wounds.

In the preferred embodiment, the top sheet can be made of a low friction nylon with an undercoating of a waterproof yet vapor permeable polyurethane. To form the plurality of apertures in the top sheet the nylon threads are simply pushed apart, but the undercoating of polyurethane has material removed to form the apertures. Over time, as the device is washed, the apertures in the nylon may close up (the plain nylon is not air tight) but the apertures in the air tight polyurethane undercoating will remain open, allowing for continual air flow through the device.

The central sheet is made out of the identical material and in the same manner as the top sheet, except there are no tiny apertures. The central sheet is a diffuser sheet in that no air flow passes through it, but it spreads the air throughout the device, allowing air to escape through the apertures in the top sheet directly to the patient. The central sheet keeps the overall waterproofness of the device (water could go through the apertures in the top sheet) and yet maintains the breathability of the device by allowing water vapor molecules to pass through so the patient does not sweat.

The bottom sheet is preferably made of a quilted synthetic material, such as DACRON™, to provide a space for the vapor molecules, once they have passed through the coated nylon upper and central sheets, to travel into and disperse. If this space did not exist, the molecules would bump into the impervious air cells of the mattress, forming a barrier (a condition known as supersaturated) that would not allow additional vapor molecules to pass through the coated nylon.

In one embodiment, the air being supplied to the device can be pumped from a compressor pump that can also be used for a alternating pressure support mattress. The compressor pump can be microprocessor controlled, and provide for control of the present invention separate from the control of the alternating pressure support surface. In one embodiment, by simply pushing a switch on the microprocessor controller, the air supply to the present device can be turned on or off, without changing any equipment.

The device does not require a very large or noisy compressor pump. The volume of air required is low because the amount of air that escapes is controlled by the position and number of apertures in the upper sheet. When the air pump is filling the alternating pressure air cells of the mattress (typically about 3 minutes out of every 10 minutes) the air is only used for inflating the air cells, not for the air distribution device of the present invention. During the time the air pump is not supplying air to the alternating pressure air cells (typically about 7 minutes out of every 10 minutes) the air is being used for the air distribution device of the resent invention.

A series of solenoid valves can open and close to have air either inflating the air cells, or inflating the present invention. Because the present invention does not increase the total volume of air required, a small quiet pump can handle the load.

Accordingly, it is an objective of the present invention to provide an air distribution device for the treatment and prevention of decubitus ulcers in which the escaping air actually reaches the patient, while the device disposed between the patient and a support surface is waterproof yet vapor permeable.

It is another objective of the present invention to provide an air distribution device for the treatment and prevention of decubitus ulcers in which the air is distributed through apertures which are made in a specific preselected pattern to provide optimum air therapy over a patient's body, yet reducing any cooling effect on the extremities.

It is a further objective of the present invention to provide an air distribution device for the treatment and prevention of decubitus ulcers that functions as a coverlet that is extremely smooth to the patient's skin (reduces shear and friction), is waterproof (protection against incontinence), and is vapor permeable to allow the body to maintain its correct temperature by allowing perspiration to evaporate (change to vapor) and pass through the coverlet to the underside where it disperses into the quilting sheet.

It is still a further objective of the present invention to provide an air distribution device for the treatment and prevention of decubitus ulcers that includes a microprocessor controlled air supply that can turn the air supply to the device on or off by simple manual selection on the controller.

In accordance with these and other objects which will become apparent hereinafter, the instant invention will now be described with particular reference to the accompanying drawings.

DESCRIPTION OF THE PREFERRED EMBODIMENTS

Figures 1, 2:
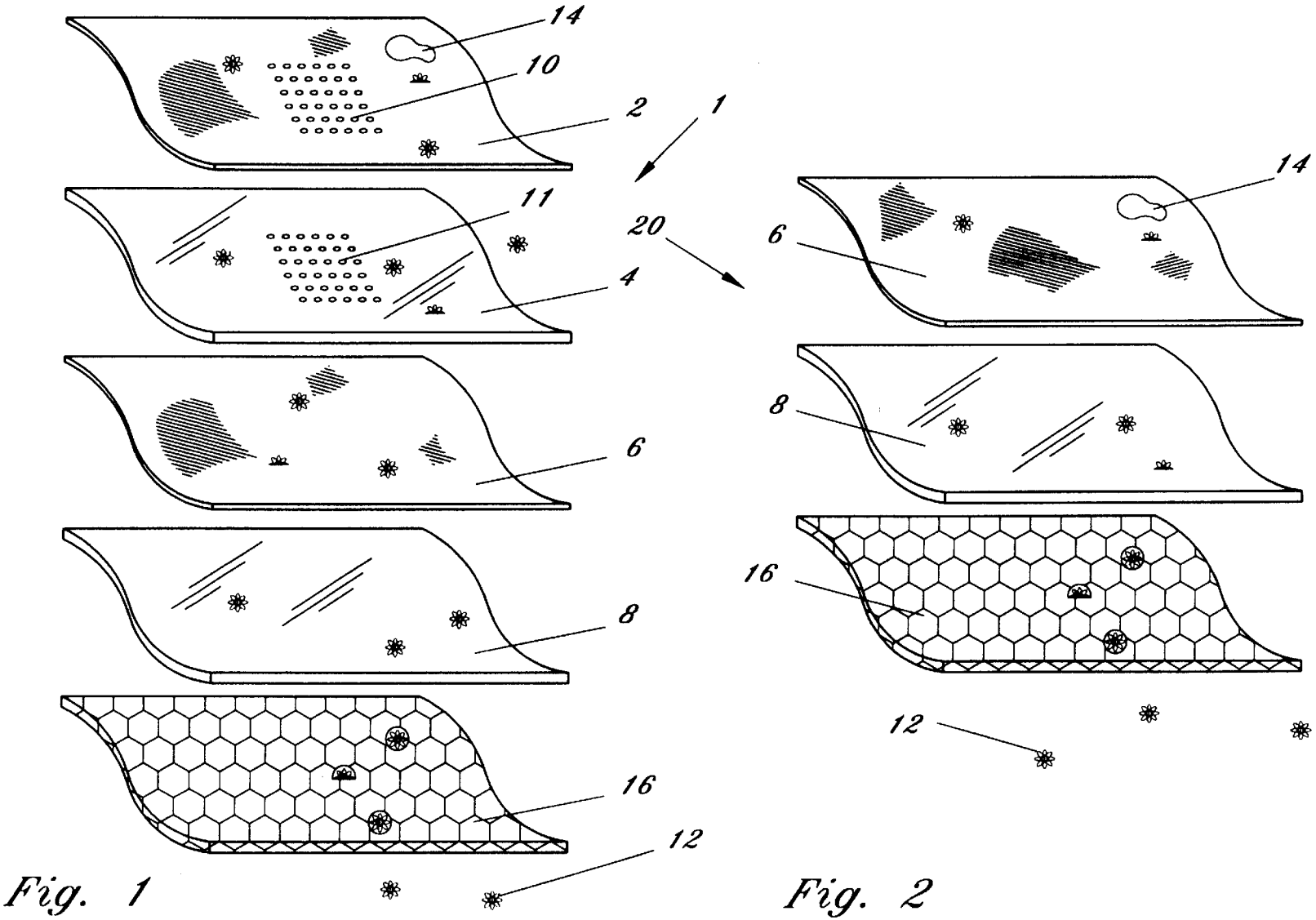
FIG. 1 is a partial exploded perspective view of the present invention.
FIG. 2 is a partial exploded perspective view of the present invention shown without the low air loss feature.

Referring to FIG. 1, the preferred embodiment of the air distribution device of the present invention is illustrated 1 for use to promote healing of, and to prevent, decubitus ulcers. Top sheet 2 is preferably made of a synthetic material such as nylon which provides low friction against a patient's skin. Top sheet 2 is undercoated with a waterproof yet vapor permeable material such as urethane 4.

There are preferably over 6000 tiny apertures 10 and 11 each provided in top sheet 2 and in undercoating 4. The apertures 10 and 11 are provided in a preselected specific geometric pattern selected to provide air circulation that most benefits the patient, and which is generally in the region directly under the patient's torso.

The apertures 10 in top sheet 2 are formed by spreading apart the nylon threads that form the nylon material of top sheet 2. The apertures 11 in urethane undercoating 4 are formed by removal of urethane material to form the apertures. As the device 1 is washed, the apertures 10 in the nylon material of top sheet 2 may close, but the apertures 11 provided in the urethane material of undercoating 4 will remain open, allowing for continual air flow through the device 1.

Central sheet 6 is preferably made of the same nylon material as top sheet 2, and is undercoated with the same waterproof and vapor permeable urethane material 8 that is provided under top sheet 2.

Central sheet 6 and undercoating 8 form a waterproof barrier which is important to prevent water 14, that may flow through apertures 10 and 11 in top sheet 2 and undercoating 4, from passing through the device 1. However, top sheet 2, undercoating 4, central sheet 6, and undercoat 8 are all vapor permeable as illustrated by water vapor molecules 12 passing through the device 1. Moisture, in the form of vapor 12, coming from the patient can thus pass through the device 1.

Figure 3:
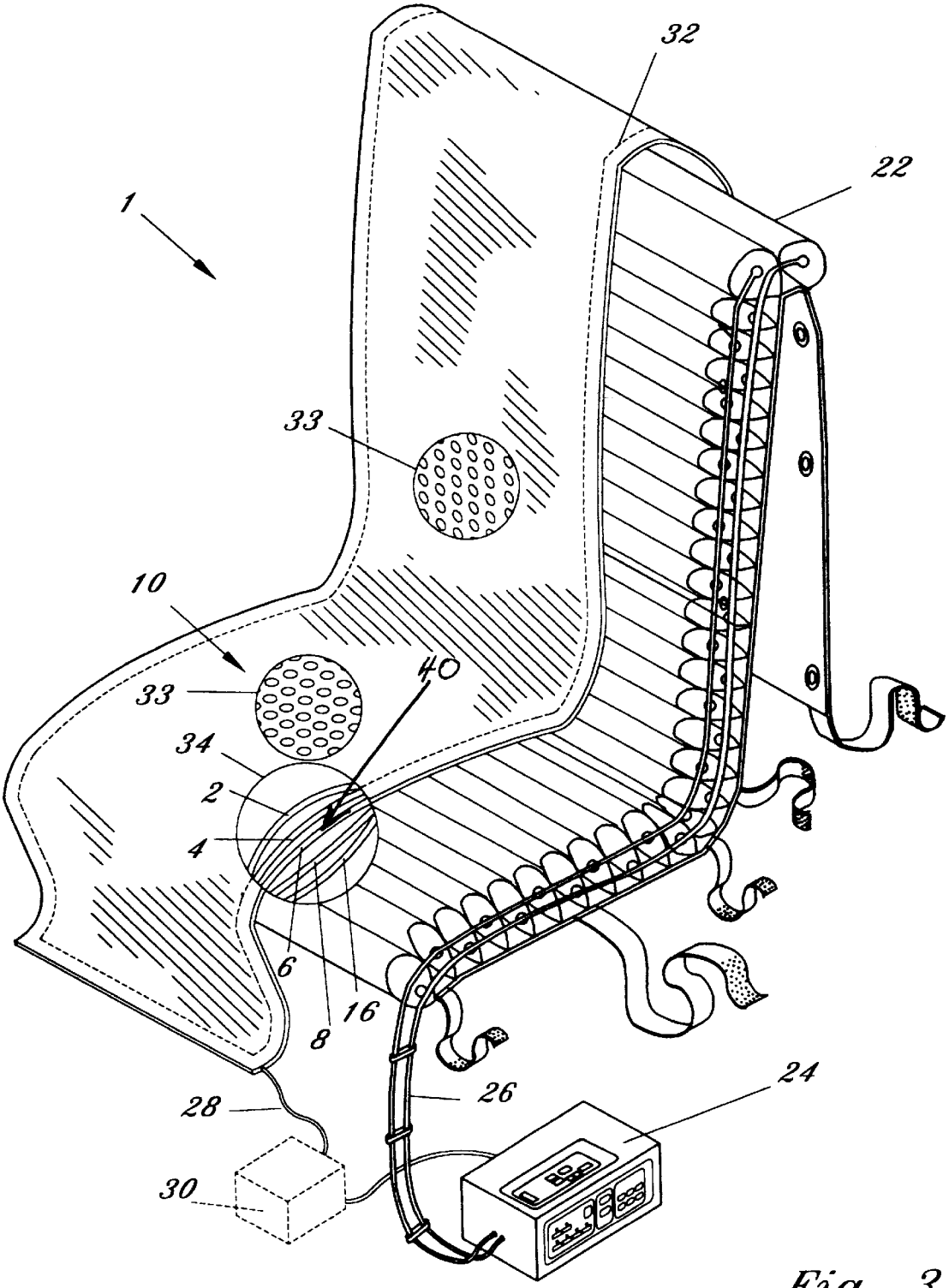
FIG. 3 is a perspective view of the present invention with an alternating inflatable mattress and controller.

Top sheet 2 and central sheet 6 including undercoating 4 and 8, are connected together near their perimeters, as illustrated at 32 in FIG. 3, forming an essentially air tight chamber 40 disposed between sheet 2 with undercoating 4 and sheet 6 with undercoating 8, except for the plurality of tiny apertures 10 and 11 provided through top sheet 2 and undercoating 4, respectively.

Bottom sheet 16 is provided to absorb and disperse vapor molecules 12 that pass from the patient through the urethane coated 4, 8 nylon sheets 2, 6 of the device 1. If bottom sheet 16 were not attached to device 1 to provide a space for the dispersion of the vapor molecules 12, the molecules 12 would bump into the support surface or underlying mattress, which would provide a vapor barrier. A supersaturated condition would quickly develop preventing additional vapor molecules 12 from passing through device 1. The patient would quickly become sweaty and uncomfortable.

It is preferable that, for overall breathability and waterproofness of device 1, the orientation of nylon central sheet 6 and undercoating 8 be such that sheet 6 faces up toward the patient and the coated side 8 faces down toward the support surface.

FIG. 2 illustrates a similar coverlet 20 without the air distribution features with identical features from device 1 indicated with identical reference numbers. It is apparent that coverlet 20 is essentially device 1, without top sheet 2 and undercoating 4. FIG. 2 represents a waterproof vapor permeable coverlet for use on a conventional alternating pressure support surface.

FIG. 3 illustrates device 1 in use on an alternating pressure support surface 22. While device 1 of the present invention can be utilized alone, it is likely to be used along with a conventional technique to reduce decubitus ulcers, and is therefore illustrated in use with an alternating pressure support surface 22.

An air supply, which may be an air compressor pump, and controller 24 is provided which supplies air to the essentially air tight chamber 40 formed between top sheet 2 and central sheet 6, and which will escape through apertures 11 and 10 to circulate around the patient.

Central sheet 6 and undercoating 8 do not allow the pumped air to flow therethrough, but together form a diffuser sheet that spreads the air throughout the space 40 formed between the sheets 2 and 6 within device 1. Air only escapes through apertures 10 and 11 in top sheet 2 and undercoating 4, respectively.

Air supply and controller 24 preferably includes a microprocessor controller and a compressed air pump to provide air for the alternating pressure mattress 22 and the present invention 1. Air flows from air supply and controller 24 through air conduit passages 26 to mattress 22, and through air conduit passages 28 to device 1. Device 1 is sealed around the perimeter 32 to form an internal essentially air tight chamber 40, except for apertures 10 in sheets 2 and 4 which are illustrated in enlarged regions 33. Enlarged region 34 shows sheets 2 and 6 with undercoatings 4 and 8, and sheet 16, which together form device 1 in the form of a low air loss cover or coverlet.

Adjustable heating element 30 can heat the air flowing through air conduit passages 28 to device 1 a preselected amount to maintain body temperature of patients utilizing the invention. Heating element 30 can be included within air supply and controller 24 or, as illustrated in FIG. 3, can be separate from controller 24. Heating the air flowing to device 1 permits the patient to be warmed slightly which improves the comfort of elderly patients and improves circulation. Air conduit passages 28 can be insulated to reduce heat loss and maintain the heated air at the preselected temperature.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An air distribution device for placing between a patient and a support surface for prevention and treatment of decubitus ulcers, comprising:

a waterproof and vapor permeable top sheet;

a waterproof and vapor permeable central sheet, said top sheet and said central sheet connected together and defining an essentially air tight chamber, said essentially air tight chamber including means for supplying air above ambient air pressure; wherein said means for supplying air above ambient air pressure includes an air compressor pump and controller, said controller including manual selection to turn on and off the air supply to said essentially air tight chamber from said air compressor pump;

a quilted synthetic bottom sheet connected to said central sheet;

said top sheet including a plurality of relatively tiny apertures therethrough in a preselected pattern, wherein air delivered to said air chamber by said means for supplying air above ambient air pressure escapes from said air chamber through said plurality of relatively tiny apertures; and said air compressor pump includes a second air supply to an alternating pressure inflatable mattress, said controller manual selection to turn on and off the air supply to said essentially air tight chamber is independent of the second air supply to said alternating pressure inflatable mattress.

2. The device as in claim 1 wherein said means for delivering air above ambient pressure includes at least one heating element for heating the air supplied to said essentially air tight chamber.

* * * * *